US006746272B2

(12) United States Patent
Bean

(10) Patent No.: US 6,746,272 B2
(45) Date of Patent: Jun. 8, 2004

(54) POWER SUPPLY ADAPTER FOR PORTABLE ELECTRONIC DEVICES

(75) Inventor: Heather N Bean, Fort Collins, CO (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 84 days.

(21) Appl. No.: 10/114,233

(22) Filed: Apr. 1, 2002

(65) Prior Publication Data

US 2002/0106934 A1 Aug. 8, 2002

Related U.S. Application Data

(63) Continuation of application No. 09/698,643, filed on Oct. 27, 2000.

(51) Int. Cl.[7] ..... H01R 11/00
(52) U.S. Cl. ..... 439/501; 439/502
(58) Field of Search ..... 439/501, 502, 439/369, 623, 622, 638, 639

(56) References Cited

U.S. PATENT DOCUMENTS 2,143,529 A * 1/1939 White ..... 206/351
4,647,139 A * 3/1987 Yang ..... 439/483
4,802,638 A * 2/1989 Burger et al. ..... 242/388.1
5,071,367 A * 12/1991 Luu ..... 439/501
5,236,371 A * 8/1993 Matthis ..... 439/501
5,326,283 A * 7/1994 Chen ..... 439/622
5,507,667 A * 4/1996 Hahn et al. ..... 439/501
5,720,628 A * 2/1998 Usui et al. ..... 439/502
5,812,683 A * 9/1998 Parker et al. ..... 381/74
5,906,506 A * 5/1999 Chang et al. ..... 439/500
5,923,147 A * 7/1999 Martensson ..... 320/111
6,109,958 A * 8/2000 Ke ..... 439/535

* cited by examiner

*Primary Examiner*—Hien Vu

(57) ABSTRACT

A power supply adapter for a portable electronic device is disclosed. The power supply adapter has a first end portion, a second end portion, and at least one channel housing portion which is recessed from the end portions. The recessed channel housing portion forms a cord-wrapping channel which is adapted to receive a cord. The cord is wrapped around the channel housing portion within the cord-wrapping channel and is removably received by a securing device. The securing device is adapted to secure the cord to the housing.

5 Claims, 6 Drawing Sheets

POWER SUPPLY ADAPTER FOR PORTABLE ELECTRONIC DEVICES

CROSS REFERENCE TO RELATED APPLICATION(S)

This is a continuation of copending application Ser. No. 09/698,643 filed on Oct. 27, 2000, which is hereby incorporated by reference herein.

FIELD OF THE INVENTION

The present invention relates generally to power supply adapters for portable electronic devices, and more particularly to power supply adapters having cords extending therefrom which are particularly adapted to be transported with portable electronic devices.

BACKGROUND OF THE INVENTION

Portable electronic devices such as notebook or laptop computers, hand-held computers or personal digital assistants, digital cameras, portable CD-RW drives, and cellular telephones may be operated from a DC power source such as a rechargeable battery or an AC-to-DC adapter. Since the life of a rechargeable battery is limited, an adapter is usually one of the accessories transported along with a portable electronic device. Such adapters are typically bulky and awkwardly-shaped, with one or more cords extending therefrom, making transportation difficult. One type of adapter 10, shown in FIG. 1, includes two cords: an electrical cord 12 having prongs 14 which plug into an electrical outlet 16, and a connecting cord 20 having a jack 22 or 23 which plugs into an external power receptor 24 on the portable electronic device 26. Another type of adapter, which is typically referred to as a "wall-wart" adapter, plugs directly into an electrical outlet 16 and includes only the connecting cord and prongs which extend from the housing of the adapter. With any adapter, it is a typical practice to either wrap the cord(s) around the adapter, which adds to the bulk and size of the adapter, or wrap each cord in a separate bundle. Either way, the ends of the cord(s) are usually left hanging loose or may come loose during transportation, which allows the cord(s) to become tangled with one another and with other accessories and items being transported with the portable electronic device. In addition, with the wall-wart type of adapter, the prongs extending from the housing of the adapter may be damaged during transportation and/or cause damage to surrounding items.

One solution has been to provide a wall-wart type of adapter with prongs that fold into the housing of the adapter. While that solves the problems associated with the prongs, the connecting cord still poses problems as noted above. The adapter may also be provided with a mechanical reel for winding the cord. However, such a reel is susceptible to breaking and substantially increases the size, cost, and complexity of the adapter.

Thus, it is an object of the present invention to provide a highly-portable power supply adapter which is particularly adapted to be transported with a portable electronic device.

It is a further object of the present invention to provide a power supply adapter which allows the cord(s) to be wrapped therearound without adding bulk and size to the adapter.

It is a further object of the present invention to provide a power supply adapter having one or more cord-wrapping channels and securing devices for the ends of the cord(s).

It is a further object of the present invention to provide a power supply adapter with a single cord-wrapping channel and securing device for the connecting cord and prongs which fold into the housing of the adapter.

SUMMARY OF THE INVENTION

The present invention is directed to a power supply adapter for a portable electronic device. The power supply adapter has a first end portion, a second end portion, and at least one channel housing portion which is recessed from the end portions. The recessed channel housing portion forms a cord-wrapping channel which is adapted to receive a cord. The cord is wrapped around the channel housing portion within the cord-wrapping channel and is removably received by a securing device. The securing device is adapted to secure the cord to the housing. The housing may have a rounded shape in order to be more aesthetically pleasing.

One embodiment of the adapter comprises a connecting cord having a jack which is adapted to be plugged into an external power receptor on the portable electronic device. This adapter has a single cord-wrapping channel which may extend partially or entirely around the circumference of the housing. Both ends of the connecting cord are preferably held within the cord-wrapping channel to provide the most compact design. A securing device is provided which is adapted to receive the jack. The securing device may be comprised of an opening in the housing and is most preferably positioned within the cord-wrapping channel. The adapter in this embodiment also comprises prongs extending from the housing which are adapted to be plugged into an electrical outlet. These prongs may be folded into a prong-receiving portion of the housing.

Another embodiment of the adapter comprises a connecting cord having a jack and an electrical cord having prongs which are adapted to be plugged into an electrical outlet. The adapter housing comprises a first end, a second end, and a middle portion which has substantially the same width as the first and second ends. The adapter has a cord-wrapping channel associated with each cord and a channel housing portion adjacent to each cord-wrapping channel. A securing device may be provided which is adapted to receive the prongs. This securing device may be comprised of openings in the housing and is most preferably positioned within the same cord-wrapping channel as the electrical cord. The securing device for the connecting cord is preferably positioned within the same cord-wrapping channel as the connecting cord. The cord-wrapping channels may extend partially or entirely around the circumference of the housing.

BRIEF DESCRIPTION OF THE DRAWINGS

Illustrative and presently preferred embodiments of the invention are shown in the accompanying drawings in which.

DETAILED DESCRIPTION OF THE INVENTION

Figure 1:
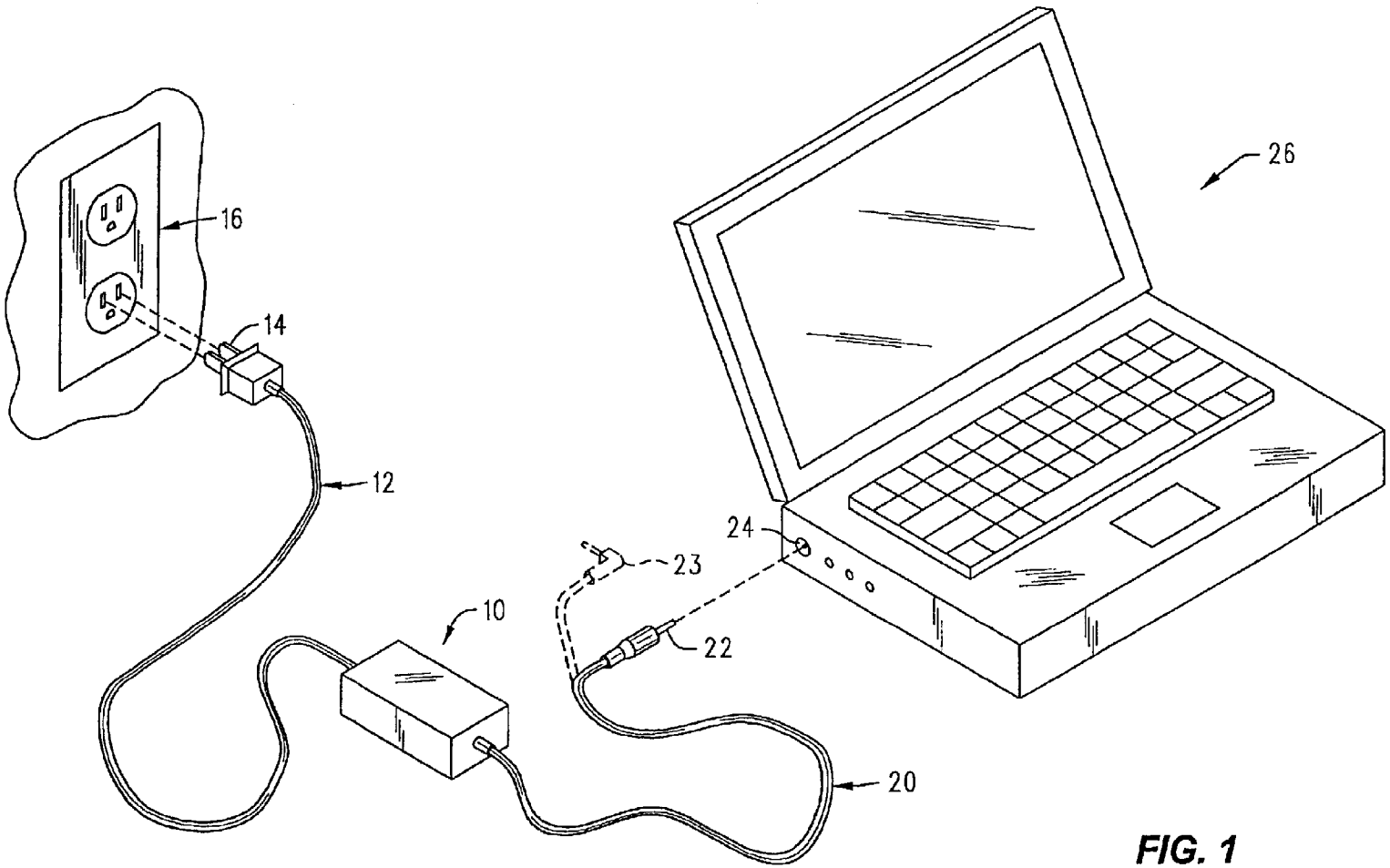
FIG. 1 is a schematic illustration of a portable electronic device, electrical outlet, and adapter.
Figure 2:
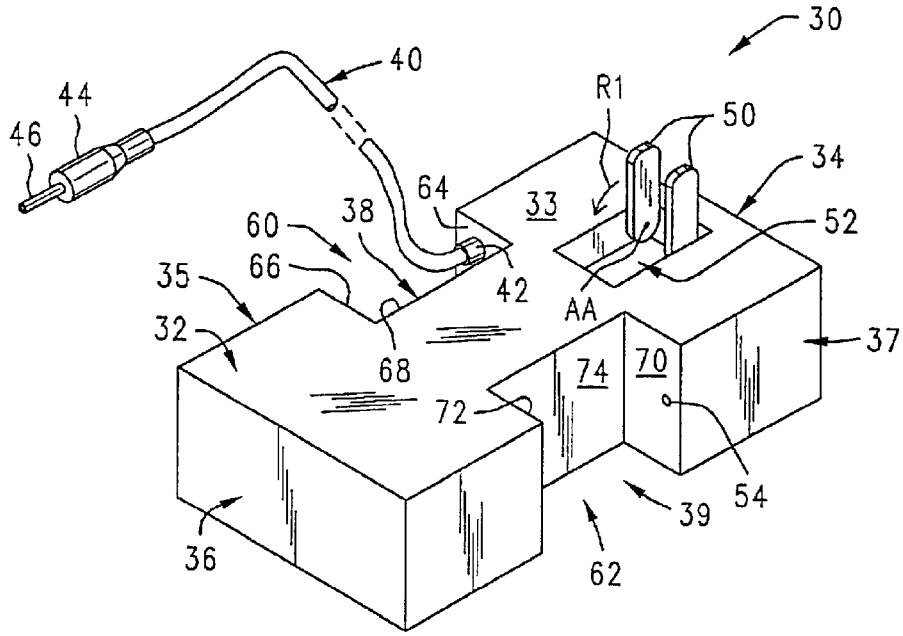
FIG. 2 is an isometric view of the adapter of the present invention having a single cord-wrapping channel.
Figure 3:
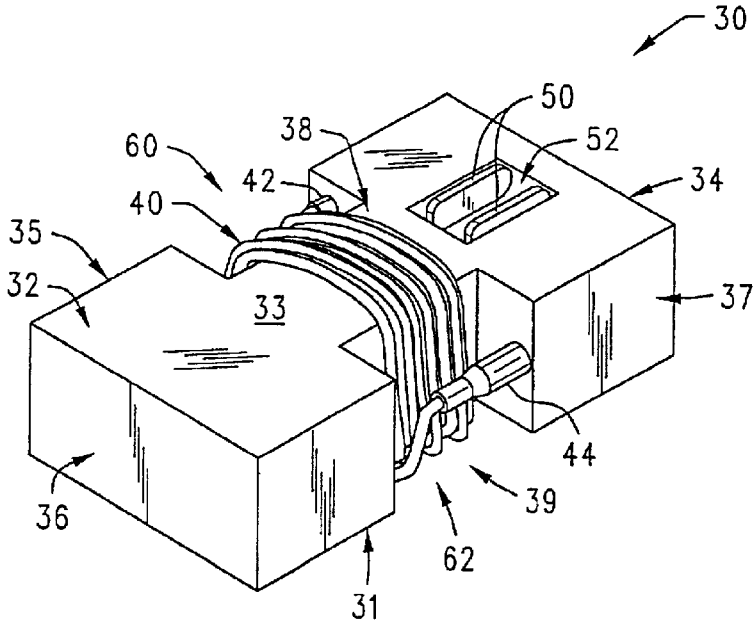
FIG. 3 is an isometric view of the adapter of FIG. 2 which is ready for transportation.
Figure 4:
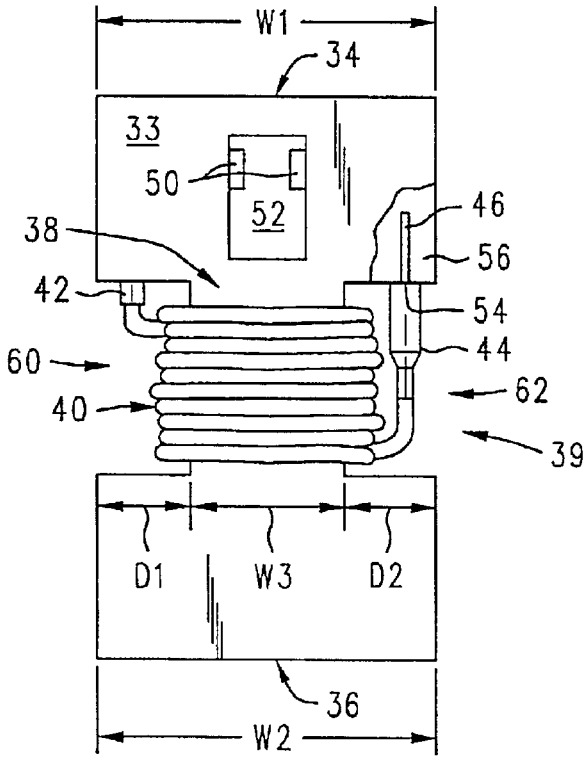
FIG. 4 is a rear side view of the adapter of FIG. 3.

FIGS. 2–4 illustrate one embodiment of the power supply adapter 30 of the present invention. The adapter 30 may comprise a housing 32 having a first end portion 34, a second end portion 36, and a channel housing portion 38. The channel housing portion 38 is recessed from the first and second end portions 34, 36, thereby forming a cord-wrapping channel 39 between the between the first end portion 34 and the second end portion 36. The adapter 30 may further comprise a connecting cord 40 having a first end 42 extending from the housing 32 and a second end 44 comprising a jack 46 which is adapted to be plugged into an external power receptor 24 on a portable electronic device 26 (FIG. 1). The first end 42 of the connecting cord 40 may be either fixedly or removably connected to the housing 32 as is well-known in the art. The jack 46 may be anything which is used in the art to connect an adapter to a portable electronic device. For example, the jack 46 may be of type shown in FIGS. 2–4 which is the same as 22, FIG. 1, or may be the same as the alternate jack 23 shown in FIG. 1.

The power supply adapter 30 shown in FIGS. 2 and 3 is a "wall-wart" type of adapter as described above and may further comprise prongs 50 extending from the housing 32 on a rear side 33 thereof which are adapted to be plugged into an electrical outlet 16 (FIG. 1). The prongs 50 are preferably foldable in a rotational direction R1, FIG. 2, around an axis AA into a prong-receiving portion 52 on the rear side 33 of the housing 32. The prong-receiving portion 52 is preferably comprised of an opening or recessed portion within the housing 32. The prong-receiving portion 52 may be sized and shaped in any manner, so long as the prongs 50 are foldable within the prong-receiving portion 52 (i.e. against and/or into the housing 32) as shown in FIG. 3. For example, the prong-receiving portion 52 may comprise a pair of elongate channels (not shown) which are adapted to receive the prongs 50 individually.

The adapter 30 may further comprise a securing device 54 which is adapted to removably secure the second end 44 of the cord 40 to the housing 32. The securing device 54 may comprise an opening in the housing 32 which is adapted to receive the jack 46, thereby providing a protective area for the jack 46 within the housing 32 and securing the second end 44 of the cord 40 to the housing 32.

FIG. 3 illustrates a power supply adapter 30 which is ready for transportation. As shown in FIG. 3, the prongs 50 are folded into the prong-receiving portion 52 of the housing 32. The connecting cord 40 is wrapped around the channel housing portion 38 within the cord-wrapping channel 39, and the second end 44 of the cord is 40 plugged into the securing device 54 (FIG. 2). As shown in FIG. 3, the "strain relief" (i.e., stiff) portions of the cord 40, namely the first end 42 and the second end 44, are most preferably held within the cord-wrapping channel 39 in order to provide the most compact design.

As shown in FIGS. 2–4, the cord-wrapping channel 39 may extend partially around the circumference of the housing 32. Thus, in this embodiment, the cord-wrapping channel 39 may comprise a first channel portion 60 on a first side 35 of the housing 32 and a second channel portion 62 positioned oppositely of the first channel portion 60 on a second side 37 of the housing 32. As best shown in FIG. 2, the first channel portion 60 may comprise a first wall 64 on the first end portion 34, a second wall 66 on the second end portion 36, and a third wall 68 on the channel housing portion 38. The second channel portion 62 may also comprise a first wall 70 on the first end portion 34, a second wall 72 on the second end portion 39, and a third wall 74 on the channel housing portion 38. The first end 42 of the connecting cord 40 may extend from any wall in the cord-wrapping channel 39, and from either channel portion 60, 62. The securing device 54 is preferably positioned on a wall, e.g., 70, within either channel portion, e.g., 62, such that the internal components of the power supply adapter 30 are minimally affected. Specifically, as shown in FIG. 4, a space 56 must provided within the housing 32 for the jack 46 to occupy when it is plugged into the securing device 54. This space 56 may be provided by re-arranging the internal components (not shown) of the adapter 30 or by providing a cutout in an internal component. Similarly, in order to provide the most compact design, the internal components may need to be re-arranged or cutouts may be provided in one or more internal components within the channel housing portion 38 in order to accommodate the channel 39. The first end 42 of the connecting cord 40 and the securing device 54 may be positioned within the same channel portion 60 or 62, and may even may positioned on the same wall. The position of the securing device 54 within the cord-wrapping channel may depend on the type of jack (e.g., 22 or 23) attached to the cord 40. For example, if a jack 23 with an angled end is utilized, the securing device 54 may be best positioned on the third wall 74 on the channel housing portion 38 so that the second end of the cord 40 is retained within the cord-wrapping channel 39.

As shown in FIG. 4, the first end portion 34 has a first width W1 and the second end portion 36 has a second width W2 (which may be equal to W1). The channel housing portion 38 has a third width W3. As shown in FIG. 4, the channel housing portion 38 is recessed from both end portions 34, 36 a sufficient distance D1 and D2 to allow the cord 40 to be neatly wrapped around the channel housing portion 38 within cord-wrapping channel 39, and to allow the second end 44 of the cord 40 to be preferably retained within the cord-wrapping channel 39, as shown in FIG. 3.

Figure 5:
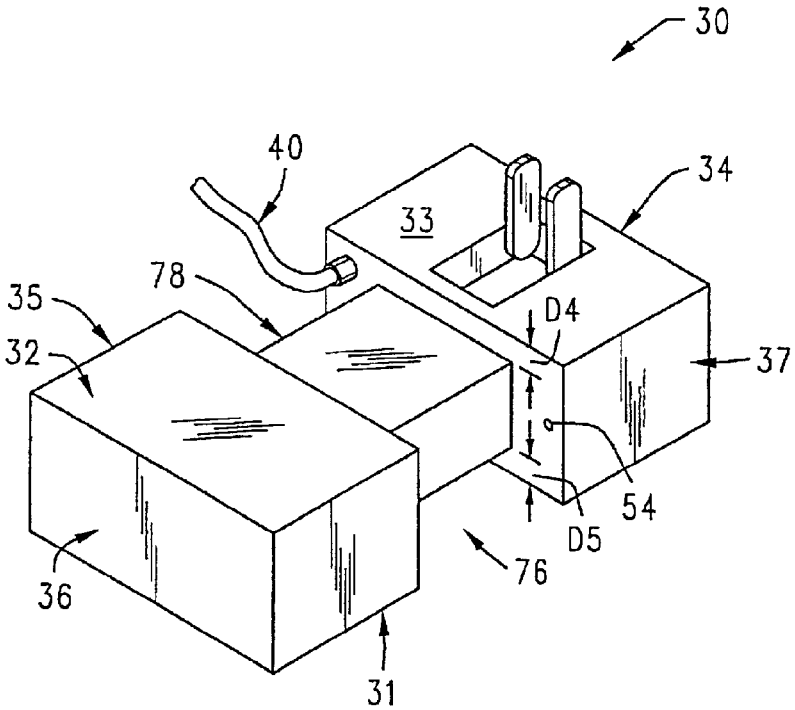
FIG. 5 is an isometric view of the adapter of FIG. 2 showing another embodiment of the cord-wrapping channel.

FIG. 5 illustrates another embodiment of the power supply adapter 30 whereby the cord-wrapping channel 76 extends around the entire circumference of the housing 32. Thus, as shown, the front side 31 and the rear side 33 of the channel housing portion 78 may also be recessed from the end portions 34, 36 a sufficient distance D3 and D4 to allow the cord 40 to be neatly wrapped around the channel housing portion 78 within the cord-wrapping channel 76.

Figure 6:
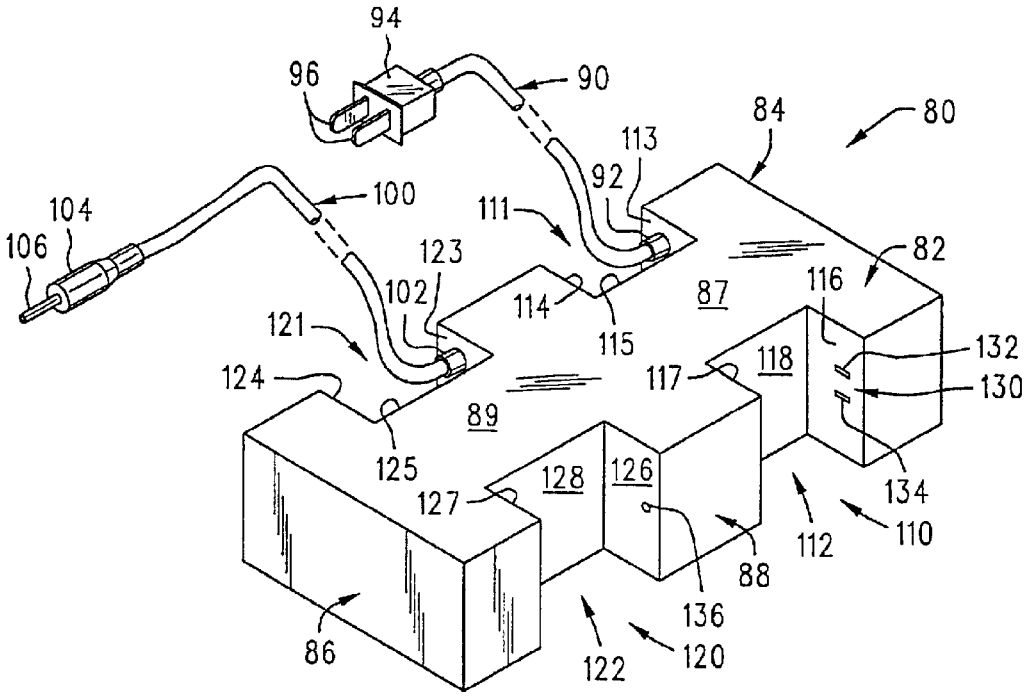
FIG. 6 is an isometric view of another embodiment of the adapter of the present invention having two cord-wrapping channels.
Figure 7:
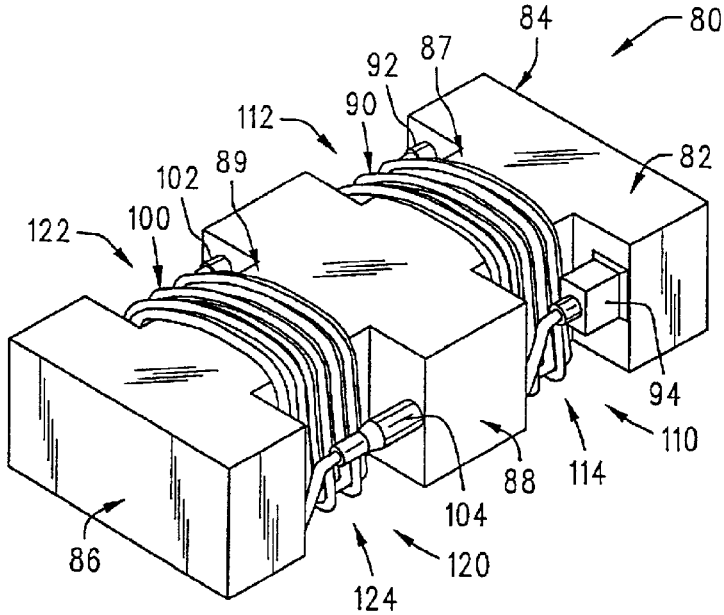
FIG. 7 is an isometric view of the adapter of FIG. 6 which is ready for transportation.
Figure 8:
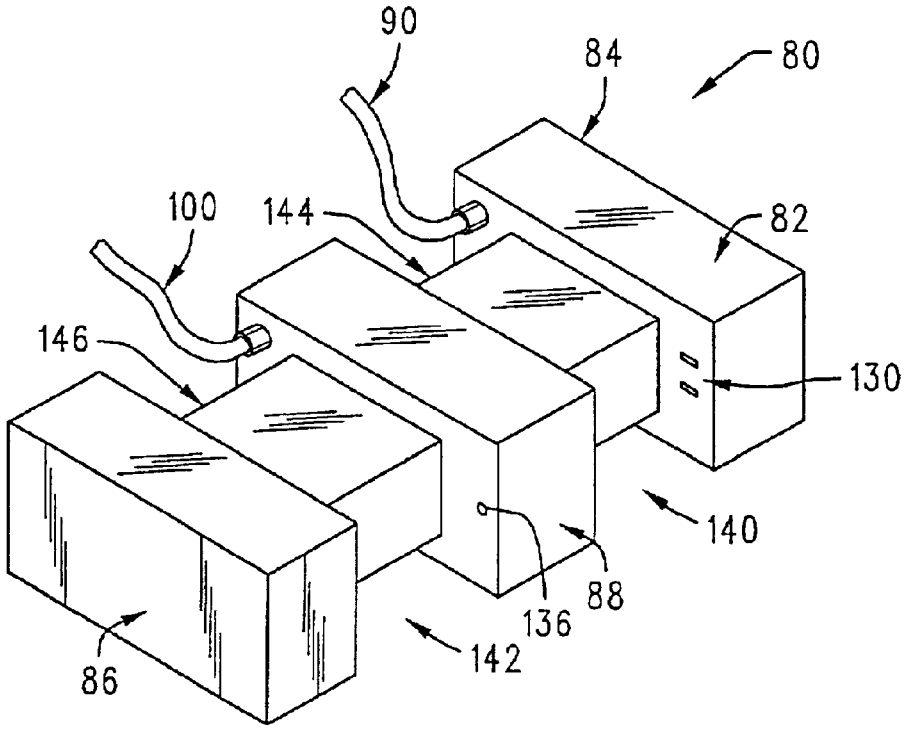
FIG. 8 is an isometric view of the adapter of FIG. 2 showing another embodiment of the cord-wrapping channel.

The power supply adapter 30 shown in FIGS. 2–5 is a "wall-wart" type of adapter as described above which includes only one cord 40 and, therefore, only one cord-wrapping channel 39, 76. Another type of power supply adapter 80 in accordance with the present invention is shown in FIGS. 6–8. This adapter 80 includes two cords: an electrical cord 90 and a connecting cord 100. Thus, two cord-wrapping channels 110, 120 are provided.

The adapter 80 may comprise a housing 82 having a first end portion 84, a second end portion 86, a middle portion 88, a first channel housing portion 87 and a second channel housing portion 89. As shown in FIG. 6, the middle portion 88 preferably has the same or similar width as the first end portion 84 and second end portion 86, which may be the same width W1, W2 as the first and second end portions 34, 36 shown in FIG. 4. The channel housing portions 87, 89 are recessed from both end portions 84, 86 and the middle portion 88, thereby forming the cord-wrapping channels 110, 120. Each of the cord-wrapping channels 110, 120, may be substantially similar to the cord-wrapping channel 39 described above and shown in FIGS. 2–4, whereby each of the channel housing portions 87, 89 are recessed from both end portions 84, 86 and the middle portion 88 a sufficient distance to allow the cords 90, 100 to be neatly wrapped around the channel housing portions 87, 89, respectively, within the cord-wrapping channels 110, 120 as shown in FIG. 7.

The electrical cord 90 may have a first end 92 extending from the housing 82 and a second end 94 comprising prongs 96 which are adapted to be plugged into an electrical outlet 16, FIG. 1. The first end 92 of the electrical cord 90 may be either fixedly or removably connected to the housing 82 as is well-known in the art. The connecting cord 100 may be substantially the same as the connecting cord 40 shown in FIGS. 2–5 and may have a first end 102 extending from the housing 82 and a second end 104 comprising a jack 106 which is adapted to be plugged into an external power receptor 24 on a portable electronic device 26 (FIG. 1). The first end 102 of the connecting cord 100 may be either fixedly or removably connected to the housing 82 as is well-known in the art. The cord-wrapping channel 120 associated with the connecting cord 100 may be substantially the same as the cord-wrapping channel 39 shown in FIGS. 2–4.

The adapter 80 may further comprise a first securing device 130, positioned within the same cord-wrapping channel 110 as the electrical cord 90, which is adapted to removably secure the second end 94 of the electrical cord 90 to the housing 82. The first securing device 130 may comprise a pair of openings 132, 134 in the housing 82 which is adapted to receive the prongs 96, thereby providing a protective area for the prongs 96 within the housing 82 and securing the second end 94 of the electrical cord 90 to the housing 92. A second securing device 136 may also be provided which may be substantially the same as the securing device 54 described above relative to FIGS. 2–4. The second securing device 136 is adapted to receive the jack 106, thereby providing a protective area for the jack 106 within the housing 82 and securing the second end 104 of the connecting cord 100 to the housing 92.

FIG. 7 illustrates a power supply adapter 80 which is ready for transportation. As shown in FIG. 7, the electrical cord 90 is wrapped around the first channel housing portion 87 within the first cord-wrapping channel 110, and the second end 94 of the cord 90 is plugged into the first securing device 130 (FIG. 6). Similarly, the connecting cord 100 is wrapped around the second channel housing portion 89 within the second cord-wrapping channel 120, and the second end 104 of the cord 100 is plugged into the second securing device 136 (FIG. 6). As noted in the embodiment of FIGS. 2–4 and shown in FIG. 8, the "strain relief" (i.e., stiff) portions of each cord 90, 100, namely the first end 92, 102 and the second end 94, 104 thereof, are most preferably held within the cord-wrapping channels 110, 120 in order to provide the most compact design.

As shown in FIGS. 6–7, the cord-wrapping channels 110, 120 may extend partially around the circumference of the housing 82, similarly to the cord-wrapping channel 39 described above. Thus, in this embodiment, the first cord-wrapping channel 110 may comprise a first channel portion 111 and a second channel portion 112 positioned oppositely thereof. Similarly, the second cord-wrapping channel 120 may comprise a first channel portion 121 and a second channel portion 122 positioned oppositely thereof. Each of the first channel portions 111, 121 may comprise a first wall 113, 123, respectively; a second wall 114, 124, respectively; and a third wall 115, 125, respectively. Likewise, each of the second channel portion 112, 122 may comprise a first wall 116, 126, respectively; a second wall 117, 127, respectively; and a third wall 118, 128, respectively.

Figure 10:
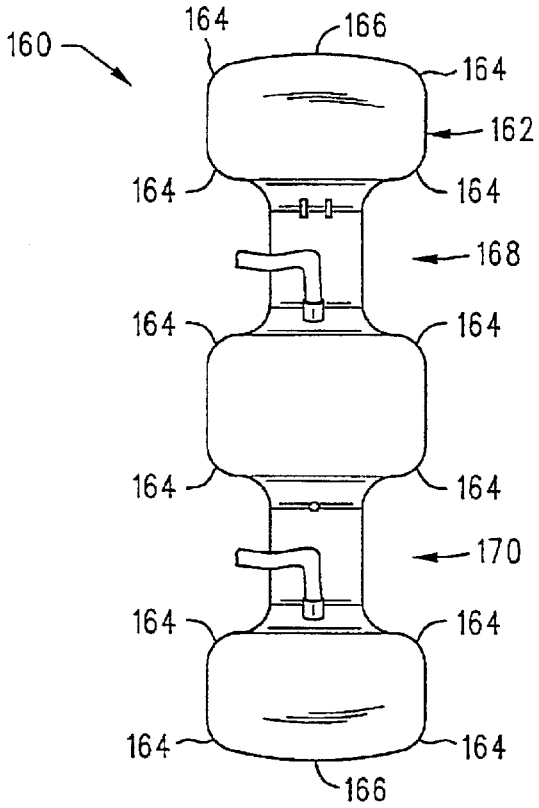
FIG. 10 is a side view of the adapter of FIG. 8 showing another embodiment of the housing.

The first end 92 of the electrical cord 90 may extend from any wall, e.g., 113, in the first cord-wrapping channel 110, for example within the first channel portion 111 thereof. The first securing device 134 for the electrical cord 90 may be positioned on any wall, e.g., 116, within the first cord-wrapping channel 110, for example within the second channel portion 112 thereof. The first end 92 of the electrical cord 90 and the first securing device 134 may alternatively be positioned in the same channel portion as shown in FIG. 10. The first end 102 of the connecting cord 100 may extend from any wall, e.g., 123, in the second cord-wrapping channel 120, for example in the first channel portion 121 thereof. The second securing device 136, like the securing device 54 described above and the first securing device 134, may also be positioned on any wall, e.g., 126, in the second cord-wrapping channel 120, for example in the second channel portion 122 thereof. The first end 102 of the connecting cord 100 and the second securing device 136 may alternatively be positioned in the same channel portion as shown in FIG. 10.

FIG. 8 illustrates another embodiment of the power supply adapter 80 whereby, like the embodiment shown in FIG. 5, each of the cord-wrapping channels 140, 142 extend around the entire circumference of the housing 82. Thus, each of the channel housing portions 144, 146 are recessed from the first end portion 82, second end portion 86, and middle portion 88 a sufficient distance so that the cords 90, 100 may be neatly wrapped around the channel housing portions 144, 146, respectively within the cord-wrapping channels 140, 142.

Figure 9:
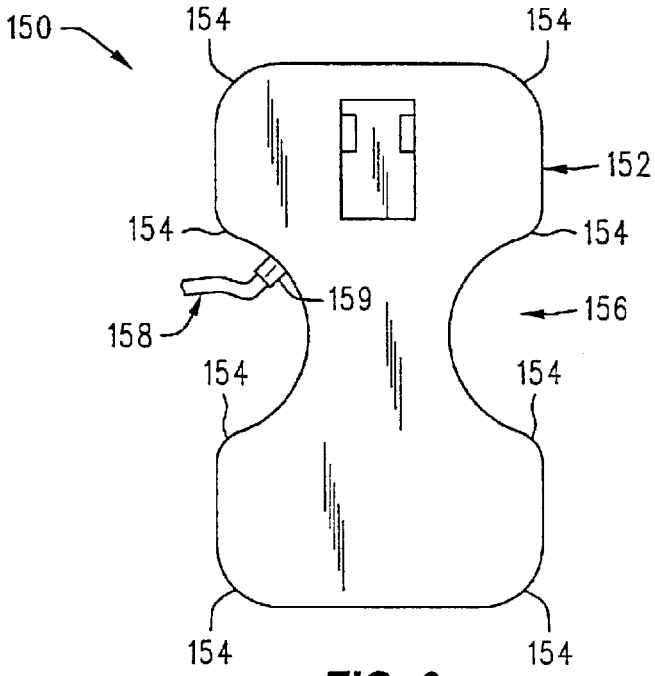
FIG. 9 is a rear view of the adapter of FIG. 2 showing another embodiment of the housing.

As shown in FIGS. 9 and 10, the edges and corners of the housing and the cord-wrapping channel(s) in any embodiment of the adapter may be rounded so as to be more aesthetically pleasing. For example, as shown in FIG. 9, an adapter 150 may be provided with a housing 152 having rounded corners and edges, e.g., 154, (and may also have rounded ends, not shown) and a rounded cord-wrapping channel 156. As shown in FIG. 9, with a rounded cord-wrapping channel, the first end 159 of the cord 158 preferably extends from a positioned within the channel such that the first end 159 preferably does not extend outside the cord-wrapping channel 156. Similarly, the securing device (not shown) would be in a position within the channel such that the second end (not shown) of the cord 158, when plugged into the securing device, preferably would not extend outside the cord-wrapping channel 156.

As another example an adapter 160, FIG. 10, may be provided with a housing 162 having rounded corners and edges, e.g., 164, and rounded ends 166. This adapter may have one or two cord-wrapping channels 168, 170 which may extend around the entire circumference of the housing 162 as shown in FIG. 10. The cord-wrapping channels 168, 170 may alternatively be of the type described above relative to FIGS. 6–7 whereby the cord-wrapping channels extend only partially around the circumference of the housing 162.

It should be noted that, while the present invention is particularly directed to AC-to-DC adapters which are typically used to power portable electronic devices, it may be applied to any transportable device having cords extending therefrom such as, for example, portable PC accessories (e.g., a mouse or a disk drive).

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

I claim:

1. A power supply adapter for a portable electronic device, comprising:

a) a housing having a circumference, a first end portion having a first width and a first thickness, a second end portion having a second width and a second thickness said first width and said first thickness are substantially identical to said second width and said second thickness respectively, and at least one channel housing portion having a third width and a third thickness which is recessed from said first end portion and said second end portion, thereby forming at least one cord-wrapping channel between said first end portion and said second end portion, said third width being substantially less than both said second width and said first width;

b) at least one cord having a first end in the cord-wrapping channel and extending from a side of one of said first and said second end portions, a second end having a lack mounted thereon, and a cord portion extending from said first end to said second end, whereby said cord-wrapping channel allows substantially all of said cord portion to be wrapped around said channel housing portion within said cord-wrapping channel;

c) at least one securing device comprising at least one opening in said cord-wrapping channel of said housing and being located on the same side of one of said first and second end portions which is adapted to securely, removably receive said jack on said cord in order to secure said jack on said cord to said cord-wrapping channel of said housing; and d) prongs extendable outwardly from said housing that are adapted to be plugged into an electrical outlet.

2. The power supply adapter of claim 1, wherein said cord-wrapping channel extends around the entire circumference of said housing.

3. The power supply adapter of claim 1, wherein said cord-wrapping channel comprises a first channel portion extending partially around said circumference of said housing and a second channel portion positioned oppositely of said first channel portion and extending partially around said circumference of said housing, and wherein said third thickness of said channel housing portion is equal to at least one of said first thickness of said first end portion and said second thickness of said second end portion.

4. The power supply adapter of claim 3, wherein said first end of said cord is positioned within said first channel portion and said securing device is positioned within said second channel portion.

5. The power supply adapter of claim 1, wherein said housing further comprises a prong-receiving portion and said prongs are foldable into and extendable from said prong-receiving portion.

* * * * *